US006076197A

United States Patent [19]

Yeung

[11] Patent Number: 6,076,197

[45] Date of Patent: Jun. 20, 2000

[54] DISINFECTING TOILET SEAT SYSTEM

[76] Inventor: Shu-Ki Yeung, 936, White Street, Saint Laurent Quebec, Canada, H4M 2W6

[21] Appl. No.: 09/222,292

[22] Filed: Dec. 28, 1998

[51] Int. Cl.[7] ..... A47K 13/00

[52] U.S. Cl. ..... 4/233

[58] Field of Search ..... 4/233

[56] References Cited

U.S. PATENT DOCUMENTS 1,215,197 2/1917 Rosen ..... 4/233

FOREIGN PATENT DOCUMENTS 6136810 5/1994 Japan ..... 4/233

6133898 5/1997 Japan ..... 4/233

*Primary Examiner*—Charles E. Phillips

[57] ABSTRACT

The disinfecting toilet seat system comprises a toilet seat with at least one seat surface, disinfecting means for disinfecting said toilet seat, containing means to hold said disinfecting means, means to trigger disinfection, means mounting said toilet seat for pivoting movement and/or seat surface sequencing relative to said containing means, and means mounting said containing means for pivoting movement relative to said toilet seat and/or mounting said containing means between said toilet seat and a toilet bowl, wherein said containing means comprises at least one element generally matching said at least one seat surface, and maintains said toilet seat disinfecting means in orientation to facilitate application of disinfection to said toilet seat when said containing means and said toilet seat are within predetermined proximity of each other.

18 Claims, 5 Drawing Sheets

*Fig. 1A*
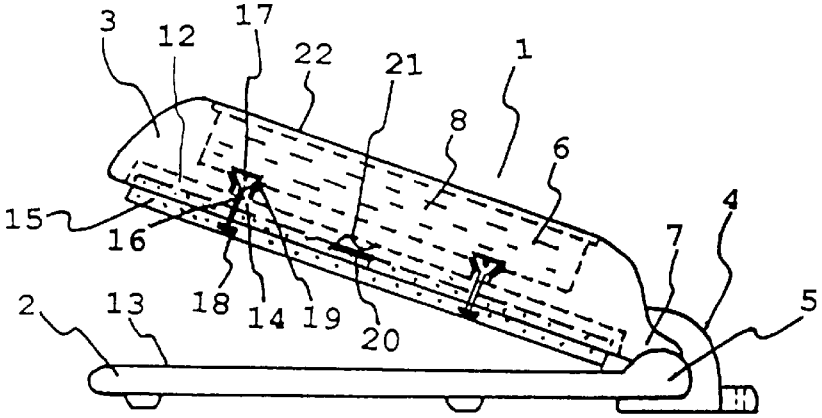
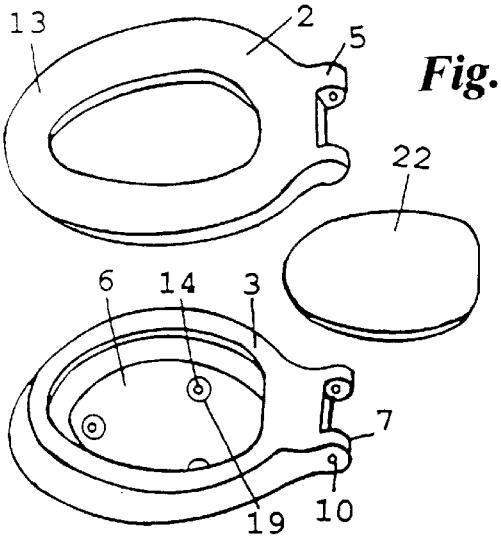
*Fig. 1B*
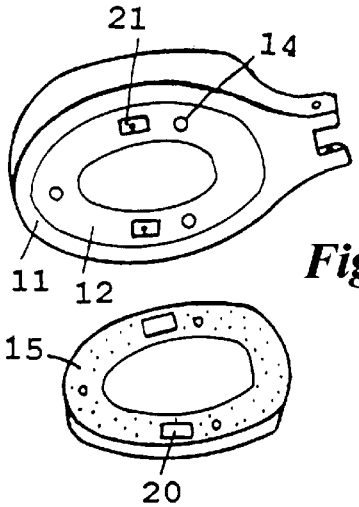
*Fig. 1C*
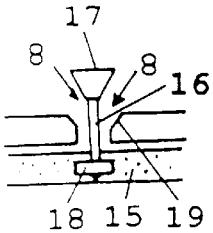
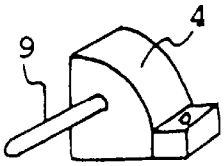
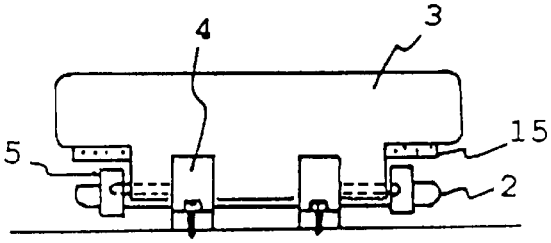
*Fig. 1E*
*Fig. 1D*

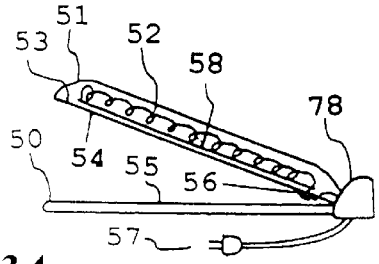
Fig. 3A
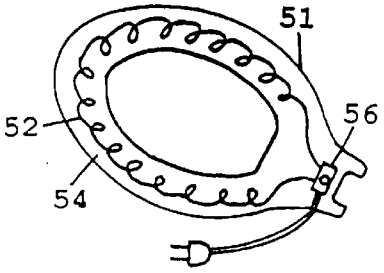
Fig. 3B
Fig. 7B
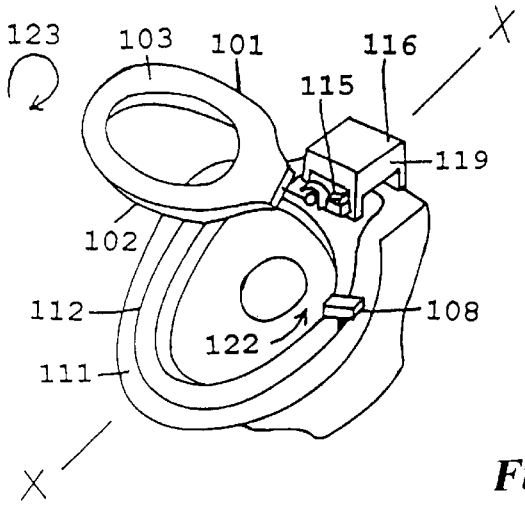
Fig. 7A
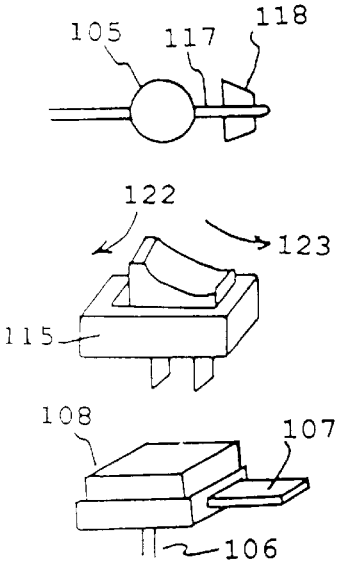
Fig. 7C
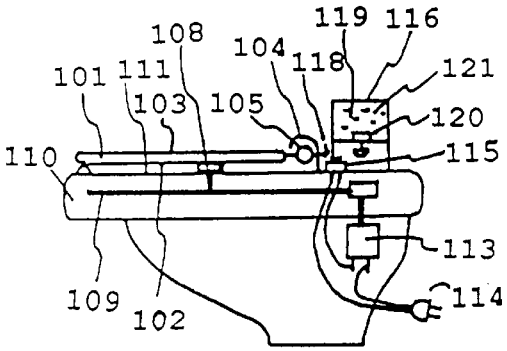

*Fig. 5A*
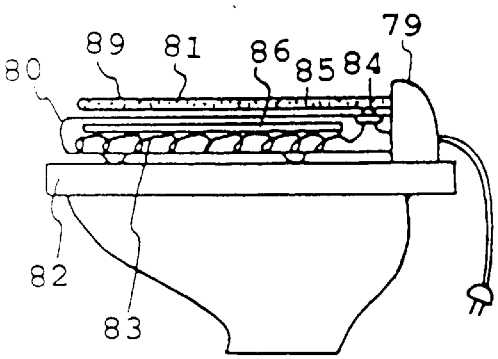
*Fig. 5B*
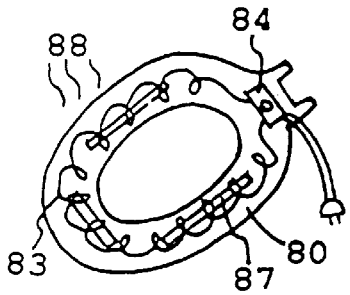
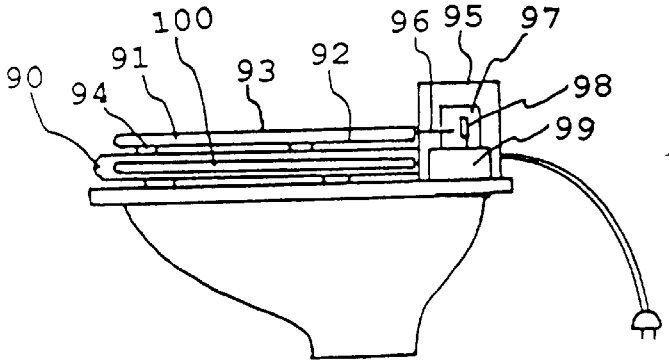
*Fig. 6A*
*Fig. 6B*
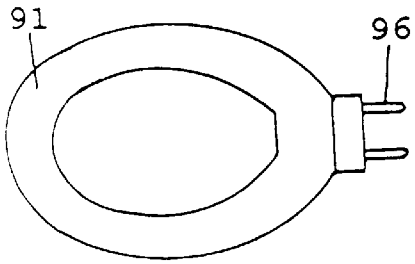
*Fig. 6C*
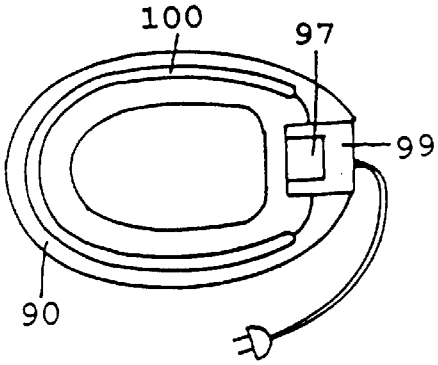

DISINFECTING TOILET SEAT SYSTEM

BACKGROUND OF THE INVENTION

1. Field of the Invention

The present invention relates to a new toilet seat system incorporated with convenient means of disinfection.

2. Brief Description of Prior Arts

Toilet seats available in the market seldom provide any means for disinfection. Those providing disinfection usually work with complicated mechanism, expensive and susceptible to frequent breakdown.

Toilet seats providing sheets to cover seat surface are also not common because people dislike sitting on sheets.

SUMMARY OF THE INVENTION

According to a broad aspect of the present invention there is provided a disinfecting toilet seat system comprising:

toilet seat with at least one seat surface, disinfecting means for disinfecting said toilet seat, at least one containing means to hold said disinfecting means, trigger means to trigger disinfection of said toilet seat, means mounting said toilet seat for pivoting movement and/or seat surface sequencing relative to said at least one containing means, and means mounting said at least one containing means for pivoting movement relative to said toilet seat and/or mounting said at least one containing means between said toilet seat and a toilet bowl, wherein said containing means comprises at least one element generally matching said at least one seat surface, and maintains said toilet seat disinfecting means in orientation to facilitate application of disinfection to said toilet seat when said containing means and said toilet seat are within predetermined proximity of each other.

In accordance with preferred embodiments of the disinfecting toilet seat system of the present invention:

said at least one containing means comprises a seat cover.

said at least one containing means comprises an intermediate layer between said toilet seat with at least one seat surface and a toilet rim.

said at least one containing means constitutes part of a toilet rim.

said system with said containing means comprising an intermediate layer or constituting part of a toilet rim further comprises a seat cover.

said toilet seat is orientable to render successive seat surfaces for disinfection.

said toilet seat further comprises a ball joint for rotational movement.

said toilet seat further comprises communication means to facilitate passing through of disinfecting agent toward said seat surface.

said system further comprises means to disinfect a toilet bowl.

said trigger means further triggers toilet bowl disinfection.

said system further comprises coupling means for coupling to toilet water delivery system in a manner that said trigger means further triggers toilet cleaning water.

said trigger means is manually operated and/or remote control operated.

said system further comprises sensing means to detect said predetermined proximity between said toilet seat and said containing means, and, in response to said predetermined proximity detected, triggers to disinfect said toilet seat.

said sensing means is sensitive to pressure and/or light and/or sound and/or radio wave and/or magnetism.

said system further comprises means to detect approaching and/or departing objects, and, in response to approaching and/or departing objects detected, triggers to disinfect said toilet seat and/or a toilet bowl.

said disinfecting means comprises at least one of liquid disinfecting agent, solid disinfecting agent, vapour disinfecting agent, freezing agent, heat generator, light generator, supersonic generator, laser, microwave generator, wiping means and brushing means.

disinfection involves at least one of direct contact, conduction, spraying, diffusion, vaporization, radiation, light transmission, wave transmission, surface tension, capillary attraction and mechanical manipulation of said disinfecting means.

disinfection discontinues automatically after a predetermined duration of time and/or after a predetermined amount of disinfectant applied.

The objects, advantages and unique features of present invention will be illustrated and explained by the following non-restrictive description of preferred embodiments thereof, given by way of example only, with reference to the accompanying drawings.

BRIEF DESCRIPTION OF THE DRAWINGS

FIG. 1A shows cross-sectional side view of embodiment with container as seat cover and with liquid desinfectant.

FIG. 1B shows seat and container with container cover.

FIG. 1C shows bottom outer surface of container and fluid absorbing felt layer.

FIG. 1D shows back view of mounting system for mounting container to seat.

FIG. 1E is an enlarged illustration for control of flow of fluid disinfectant.

FIG. 3A shows cross-sectional side view of embodiment with heater inside seat cover.

FIG. 3B shows bottom view of container with pressure switch for automatic triggering.

FIG. 5A shows cross-sectional side view of embodiment with container as intermediate layer.

FIG. 5B shows top view of container layer with pressure switch and vapor slots.

FIG. 6A shows cross-sectional side view of electronic embodiment with intermediate layer and seat adapted for sequencing seat surfaces.

FIG. 6B shows double-surfaced seat for sequencing.

FIG. 6C shows top view of container layer with light bulb and electronic control unit.

FIG. 7A shows embodiment with rotatable sequencing seat and container as toilet rim and with wiper for disinfection.

FIG. 7B shows cross-sectional side view of embodiment.

FIG. 7C shows components for triggering disinfection by seat surface sequencing.

DETAILED DESCRIPTION OF THE PREFERRED EMBODIMENTS

Figure 2A:
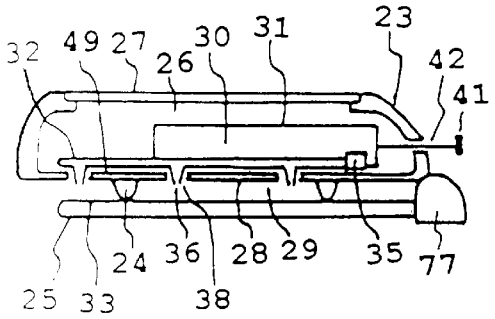
FIG. 2A shows cross-sectional side view of embodiment with container as seat cover and with vapor disinfectant.

A preferred embodiment of the disinfecting toilet seat system of the present invention is illustrated in FIG. 1, and is generally identified by the reference 1.

Referring to FIG. 1A, showing a side view, system 1 includes a toilet seat 2, and a disinfectant container 3 which also serves as a toilet seat cover. Both seat 2 and container 3 are mounted to same axis on mounting blocks 4 for pivotal movement.

FIG. 1B shows top view of seat 2 and container 3. Seat 2 consists of end caps 5 as shown. Container 3 defines a hollow chamber 6 with lid 22, serving as holder for liquid disinfecting agent 8. Container 3 matches the outline of seat 2 and extends to form mounting flanks 7 at its far end. Horizontal shafts 9 of mounting blocks 4 go through flanks holes 10 of flanks 7 and into end caps 5, so that container 3 forms a swivel seat cover. FIG. 1D shows a back view of the mounting system and details of block 4, to be fixed to a toilet basin with screws (not shown).

As shown in FIG. 1C, the outer bottom surface 11 of container 3 defines a shallow recess 12 which generally matches shape of seat surface 13 of seat 2. Holes 14 at appropriate positions along recess 12 go through container 3 bottom to serve as communication passages to allow liquid disinfecting agent 8 to flow toward recess 12.

A fairly rigid fluid absorbing felt layer 15, matching seat surface 13 in shape, is attached to recess 12 by means of screws 16 with tapering screw heads 17, which go through holes 14 and are locked by nuts 18 as shown. Holes 14 comprise tapering circular indents 19 with curvature matching tapering heads 17 of screws 16, so that when tapering screw heads 17 rests on indents 19, no liquid can pass through holes 14.

Evenly spaced plastic plates 20 are adhered to top surface of fluid-absorbing layer 15. Springs 21 are fixed to recess 12, exactly facing plastic plates 20 so that a gap is maintained between outer bottom surface 11 and fluid-absorbing layer 15 by spring force when no external pressure is applied to the springs. This assures screw heads 17 fitting into indents 19 to allow no liquid going through holes 14 when container 3 is away from seat 2.

When container 3 is swiveled to rest on seat 2, its weight flattens springs 21. Felt layer 15, is thus pushed upwards by seat surface 13. Simultaneously screws 16 are also pushed upwards, allowing liquid disinfecting agent 8 to pass through holes 14 to felt layer 15, as per FIG. 1E. Passing through felt layer 15, disinfecting agent 8 reaches seat surface 13, thus disinfecting toilet seat 2. Diameter of holes 14 and felt material are so chosen that disinfectant 8 basically stops passing through holes 14 when micro pores in felt layer 15 are saturated.

Thus a user always finds a disinfected toilet seat by simply lifting up the seat cover (container 3). After using the toilet, the user lowers the cover, and a well disinfected seat is ready to welcome the next user.

Whilst disinfection in normal horizontal position is illustrated, seat 2 can actually be disinfected whenever container 3 and seat 2 lean onto each other, as long as pressure is exerted on springs 21, although the horizontal position would render best results, and most convenient to user. As micro pores in felt layer 15 actually suck liquid by capillary attraction and surface tension, disinfectant 8 eventually diffuse to saturate felt layer 15 as long as one or more of holes 14 allow disinfectant 8 to pass through.

Although a pivotally mounted system is described, other mounting systems may also be employed. Also, whilst spring action to control passing of liquid disinfectant is described, any actuation means to trigger disinfection, whenever seat 2 and container 3 reach a predetermined proximity, are within scope of this invention.

Another preferred embodiment is shown in FIG. 2. Container 23 with hollow chamber 26 and lid 27, serving also as seat cover, is mounted to mounting block 77 to pivot against seat 25, which is also pivotally mounted, though can also be fixed. Studs 24 located at outer bottom surface 28 of container 23 assures a gap 29 between seat 25 and container 23 as per cross-sectional side view FIG. 2A.

Pressurized disinfectant 30 stored in metal can 31 is employed. Metal tubing 32 with evenly spaced spray nozzles 36, and shaped to match seat surface 33, is coupled with adaptor 35 to ejection outlet 34 of can 31 as per FIG. 2B.

Figure 2B:
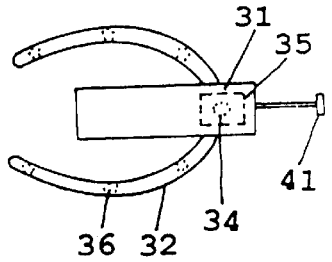
FIG. 2B shows disinfectant can and spray tubing, inner bottom surface of container with slot and guard ribs for holding can and tubing, and seat surface.
Figure 2B:
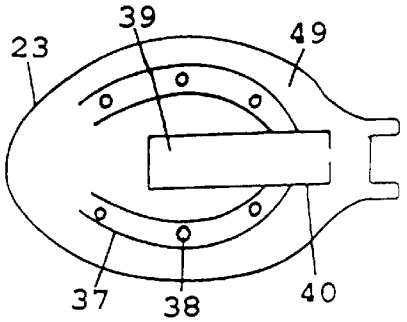

FIG. 2B shows top view of container 23 inside bottom surface 49 and top view of seat 25 with seat surface 33. Guide ribs 37, matching seat surface 33, fix tubing 32 in proper position. Bottom holes 38 are in full match with spray nozzles 36 so that each spray nozzle 36 fits into a corresponding hole 38. Can 31 is fitted into slot 39 with gripping ribs 40 such that ejection outlet 34 couples with adaptor 35 on tubing 32. Push-button trigger 41 protrudes outside through opening 42 on frame of container 23. With container 23 resting on top of seat 25, when user pushes trigger 41, disinfectant 30 will thus be sprayed onto seat surface 33.

Figure 2C:
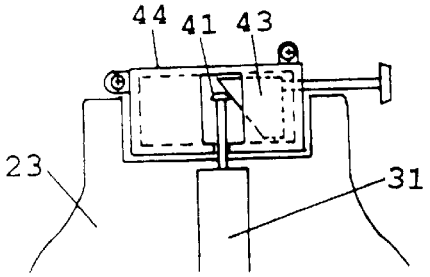
FIG. 2C shows cross-sectional view of trigger guide to facilitate side-triggering.
Figure 2C:
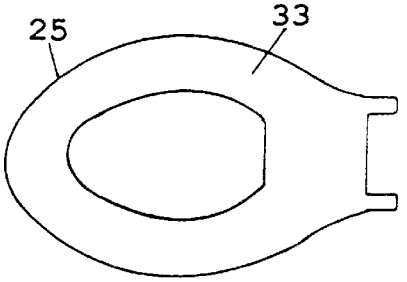

For user convenience, it would be desirable to trigger from side of toilet. FIG. 2C shows top view of trigger guide 44 mounted close to can trigger 41. Spade trigger 43 has a slanting surface so that when pushed, it in turn perpendicularly push can trigger 41 to spray disinfectant. Of course, alternative perpendicular trigger device may be used instead of spade trigger to effect side triggering.

Figure 2D:
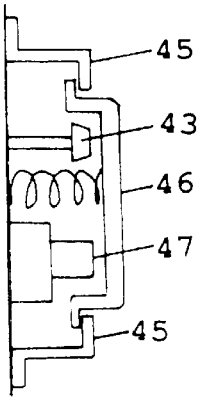
FIG. 2D shows cross-sectional view of coupler to effect simultaneous triggering of seat disinfection and toilet cleaning water.

With a special coupler 45 coupling spade trigger 43 to flushing trigger 47 of a toilet, pushing dual trigger 46 can simultaneously trigger toilet seat disinfecation and toilet flushing, as shown in cross-sectional view FIG. 2D. Different couplers may be needed for different toilet designs. In case of turning handles, cams may be needed inside the coupler to effect simultaneously triggering.

Figure 2E:
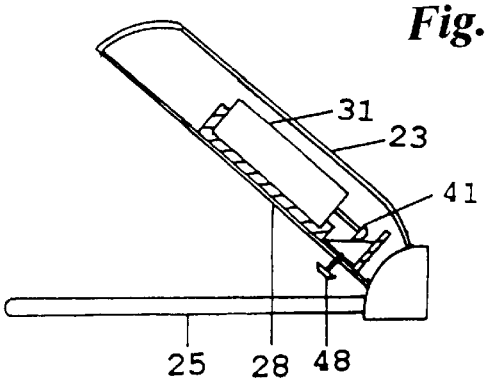
FIG. 2E shows cross-sectional view of embodiment for automatic triggering.

With a similar perpendicular spade trigger, and with trigger handle 48 protruding through container bottom surface 28, automatic triggering is achieved per FIG. 2E, cross-sectional side views. As seat cover container 23 is swiveled to rest on top of seat 25, trigger handle 48 is pushed upward. Its slanting surface in turn presses on trigger 41 to actuate spraying of disinfectant onto seat 25. As a normal design of spray can, spraying stops when trigger 41 stops travelling. This embodiment thus has additional advantage that a specific amount of disinfectant is sprayed for every operation. Trigger 41 automatically returns to standby when container 23 is away from seat 25.

FIG. 3 shows another embodiment where disinfection is automatically effected whenever seat 50 and container 51 come into contact. Both seat 50 and container 51 are mounted to mounting block 78 for pivotal movement with container 51 serving as seat cover as per side view FIG. 3A.

Heating element 52 is embedded inside container 51. Bottom plate 53 of container 51 is made of good heat conducting material. Mica sheet 58 between heating element 52 and bottom plate 53 assures electrical insulation. FIG. 3B shows bottom view of container 51. Outside surface 54 is shaped to fully match seat surface 55 for best heat conduction. Pressure-sensitive on/off switch 56, with built-in timing circuitry, located near pivot joint and facing seat surface 55, connects heating element 52 to power cord 57 for plugging to nearby electric source.

Whenever container 51 and seat 50 come into contact, on/off switch 56 will be pressed on, and heat generated by heating element 52 will be transmitted from bottom plate 53 to seat surface 55 by conduction to kill bacteria. A monostable flip-flop, or other simple timing circuitry associated with on/off switch 56, serves to cut off heating element 52 automatically after a period of time.

Alternatively, 2 heating elements of different ratings may be employed. When container 51 and seat 50 come into contact, on/off switch 56 will initially switch on a first heating element with higher rating to create a higher temperature for disinfection. After a predetermined period of time, the timing circuitry automatically switch connection to a second heating element with lower rating to keep seat 50 warm, for user comfort.

Whilst heat conduction is herewith described, heating element can be replaced with freezing agents to create low temperature to kill bacteria. A cool toilet seat will also be welcome in a hot summer day. Alternatively other disinfecting means, for example, microwave, supersonic wave or laser, may also be employed in place of heating element to effect disinfection by radiation or wave transmission.

Figure 4A:
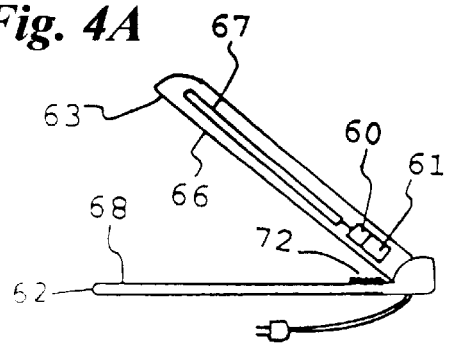
FIG. 4A shows cross-sectional side view of electronic embodiment.
Figure 4B:
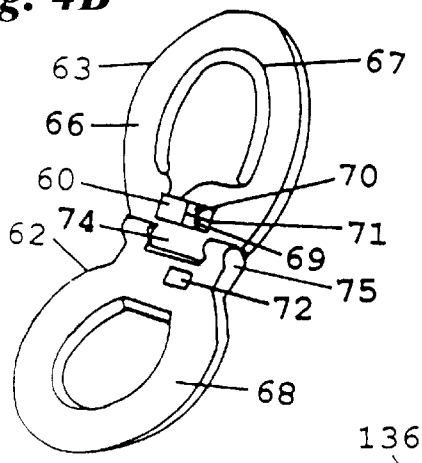
FIG. 4B shows container bottom surface with electronic control and seat with reflector.
Figure 4C:
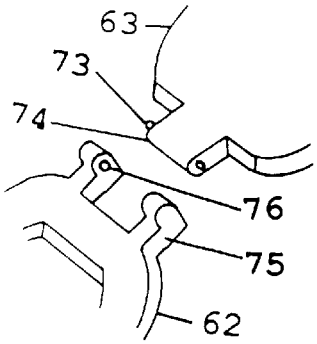
FIG. 4C shows matching details for fixing container to seat.

FIG. 4A & 4B show respectively side view and top view of an electronic embodiment of present invention. Ultra-violet light generator 60 is housed inside container 63 and connected to electronic control unit 61 located near end ledge 74. Mounting studs 73 at sides of ledge 74 match mounting grooves 76 at inner side of flanks 75 of seat 62, so that when studs 73 are fitted into grooves 76, seat 62 and container 73 become pivotal relative to each other, with container 63 serving as seat cover, as per FIG. 4C.

Bottom plate 66 of container 63 is transparent to allow light passing through. Ultra-violet light bulb 67 is shaped to match seat surface 68. Electronic control unit 61 with built-in timer is pulse-triggered and has a light emitting device, LED 69, and a light sensor 70 positioned side by side with partition 71 in between so that light from LED 69 cannot directly reach sensor 70. A light reflector 72 is adhered to seat surface 68 so that when container 63 comes to rest on seat 62, light emitted by LED 69 will be reflected by reflector 72 to light sensor 70. The first reflected light pulse received by light sensor 70 turns on generator 60 to emit ultra-violet light to disinfect seat 62. Disinfection stops automatically after a desirable period of time. When a user lifts up the seat cover container 63, the reflected light source is removed and control unit 61 returns to standby so that the next light pulse, when container 63 is lowered again, will trigger another disinfection.

With simple receiver unit included in control unit 61, disinfection may be remote-controlled. With a transmitter, a user can thus send a signal to disinfect the toilet seat in his next room toilet. Remote control can be effected by radio signal, sound, or light, including infra-red light. Manual trigger can be added to any automatic embodiment for user selection and to safeguard automatic means breakdown.

For users necessarily preferring a freshly disinfected seat prior to use, a proximity sensor can be incorporated into electronic control unit 61 to detect an approaching user. Whenever a user is detected, the proximity sensor sends pulse to control unit 61 to automatically start a fresh disinfection. Alternatively electronic control unit 61 may be programmed to actuate disinfection upon departure of a user to assure a disinfected seat for the next user.

Whilst ultra-violet light is herewith described, other disinfecting means, including microwave, supersonic wave and heat may also be used with appropriate modifications. Further, other sensing means, including magnetic sensors, proximity sensors, radio sensors etc may also be employed in addition or substitution to light reflector described, and are within scope of this invention.

For users who prefer a thin seat cover, an alternative preferred embodiment is shown per FIG. 5A, with an intermediate container layer 80 between seat 81 and toilet basin rim 82. Seat 81 is mounted to mounting block 79 for pivotal movement relative to container layer 80, whilst layer 80 can be fixed to toilet basin or remains pivotable.

Seat 81 is made of porous material with numerous micropores 85 so vapour can pass through. Container layer 80 matches seat 81 in outline, and has a built-in heater 83 with pressure switch 84 plugged for electricity supply.

Volatile solid disinfecting agent 86 is placed above heater 83. When seat 81 rests on layer 80, its weight presses on pressure switch 84 and therefore switches on heater 83. When heated, solid agent 86 emits disinfecting vapour 88.

Escaping through slot openings 87 on top frame of layer 80, then passing through the pores inside seat 81, vapour 88 finally reaches seat surface 89 for disinfection. FIG. 5B shows top view of container layer 80. A timing device can be added for optimum duration of disinfection. If preferred, seat 81 can be fixed instead of pivoting, with switch 84 adapted for manual triggering.

Many users prefer luxury and relax in toilet rooms. This invention thus renders an additional advantage of providing convenient fragrance when disinfectant with pleasing fragrance is used as disinfectant 86. Further, this embodiment may also include a seat cover. Of course, for users particularly serious about toilet hygiene, this seat cover may also be an additional disinfectant container so that double disinfection can be achieved whilst pleasing fragrance also provided. Two disinfecting containers used also provides safeguard when the previous user lifted only the seat cover but not the seat, or vice versa.

Although a solid disinfecting agent that emits vapour is herewith described, liquid disinfectants may also be used. Any disinfecting means that passes from one surface of a toilet seat to another surface are within scope of this invention. Also, any suitable sensing means may be used instead of pressure switch.

FIG. 6 shows another preferred embodiment with intermediate container layer 90 and a toilet seat 91 with interchangeable dual seat surfaces 92 and 93. Container layer 90 matches seat 91 in shape, and consists of evenly located support studs 94 for supporting seat 91. Housed along inside rim of layer 90 is an ultra violet light bulb 100, shaped to match seat surface 92. With a transparent frame, layer 90 is mounted to a mounting block 95. Seat 91 consists of magnetic mounting poles 96 for coupling to pole holder 97 inside mounting block 95. Inside pole holder 97 is a magnetic reed switch 98. When poles 96 are inserted to holder 97, reed switch 98 is triggered to send a pulse to electronic control unit 99, also housed inside mounting block 95, to turn on ultra-violet light bulb 100 to emit ultra-violet lights to disinfect seat surface 92 which is meanwhile facing layer 90.

A toilet user pulls out toilet seat 91 from mounting block 95, reverses it so that disinfected seat surface 92 faces up, then inserts seat 91 back to mounting block 95. Disinfected surface 92 is now ready for user. Inserting poles 96 back to pole holder 97 triggers another light emission to disinfect seat surface 93. Control unit 99 also consists of a timer to optimize disinfection duration.

A seat cover is preferably included. Of course, this seat cover can be an additional disinfectant container. With pole holder 97 designed pivotal, seat 91 can also become pivotal, so that a user can select to just lift up seat 91 toward seat cover container for disinfection, or seat surface sequencing by pulling out seat 91 to reverse its surfaces. In either case, this guarantees disinfection against different user habits.

Although a detachable and reversible toilet seat is herewith described, any seat rendering successive surfaces to approach intermediate container layer for disinfection are within scope of this invention. Further, container layer can be modified to hold different disinfecting means employed, and not be limited to ultra violet light.

FIG. 7 shows another preferred embodiment with disinfecting means container forming basin rim of a toilet.

Toilet seat 101 consists of 2 seat surfaces 102 and 103, and a spherical ball joint 105 at its end, mounted to a socket 104, for rotational movement. Socket 104 is fixed to a toilet basin rim surface 111. Disinfection means is a wiper 108 with handle 106 and side fang 107. Handle 106 is connected to a chain 109 inside a rim-container 110 merged as a toilet rim. Wiper 108 stays above toilet rim surface 111 with handle 106 going through a rim slot 112 which runs along the whole rim surface 111, with an generally oval locus matching shape of seat surface 102. Chain 109 is connected to an electric motor 113 so when motor 113 is running, chain 109 drives wiper 108 to travel along toilet rim surface 111 in anticlockwise circulation.

FIG. 7B is a cross-sectional view of the toilet along longitudinal axis XX. Motor 113 is connected to toggle switch 115 which is connected to power cord 114 for electricity supply. At standby with toggle switch 115 off, wiper 108 stays inside entrance of a tank block 116.

Ball joint 105 consists of a short rod 117 protruding beyond and outside socket 104 as shown in FIG. 7C. Rod 117 comprises two actuator wings 118 in opposite directions, so when a user rotates seat 101 in clockwise direction 123 to reverse its surfaces, one of actuator wings 118 will turn on toggle switch 115. Consequently, wiper 108 starts circulating by first going further into tank block 116. Block 116 consists of an upper compartment 119 for storing liquid disinfectant 121. A stopper 120 located at bottom of compartment 119 serves as on/off control of flow of disinfectant 121. As wiper 108 travels to reach stopper 120, it pushes stopper 120 upwards to allow liquid disinfectant 121 to flow downwards into and be absorbed by wiper 108. When wiper 108 starts leaving tank block 116, stopper 120 returns to its standby position and therefore stops liquid disinfectant 121 from flowing out.

Wiper 108 has a height that it just touches lower seat surface 102, so when wiper 108 circulates, surface 102 is wiped clean and disinfected by disinfectant 121.

When wiper 108 has completed its circulation and starts to enter tank block 116 again in anticlockwise direction 122, side fang 107 pushes toggle switch 115 to off position, thus disconnecting electricity supply. Whole system thus returns to standby status until next toilet user rotates seat 101 to turn surface 103 for disinfection.

Hence a disinfected seat surface is always standby and a user need simply rotate the dual surface seat. Further advantage is that besides disinfection the seat surface is actually wiped clean. Seat cover can also be added.

Whilst a wiper is described, a brush or any suitable disinfecting means can be contained in a specially structured toilet rim for disinfection of a toilet seat. Further, ball joint 105 may also be adapted to be motor driven so that both seat reversing and disinfection operate automatically upon press of a switch or by remote control in response to signals received by proximity sensors, light sensors, sound sensor or magnetic sensors etc.

Figure 8A:
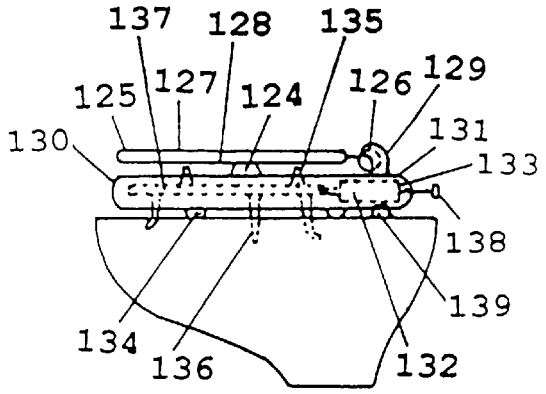
FIG. 8A shows cross-sectional side view of embodiment with intermediate layer for simultaneous disinfecting of seat and toilet bowl.
Figure 8B:
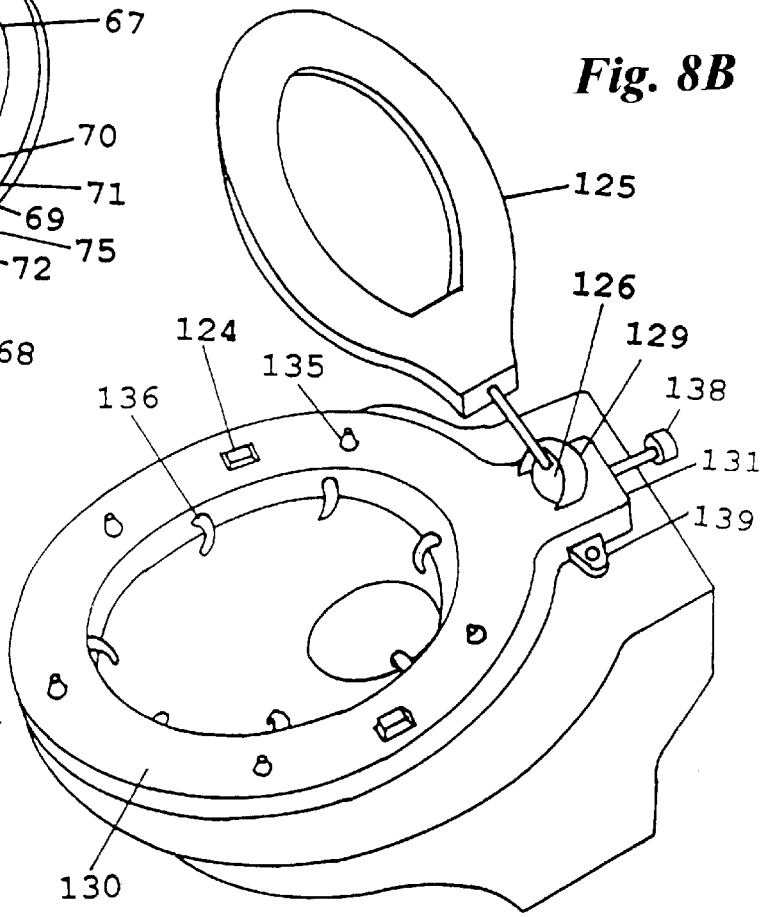
FIG. 8B shows rotational seat and disinfecting layer as mounted to toilet bowl.

FIG. 8 shows an embodiment serving to disinfect both toilet seat and toilet bowl simultaneously. Container 130, matching seat 125 in shape, forms an intermediate layer between seat 125 and a toilet rim. Seat 125 has 2 seat surfaces 127 and 128 and a ball joint 126 coupled to socket 129 for sequencing as shown. Container 130 is hollow inside forming a gas chamber 137 and extends at the end to form housing 131 to support socket 129 and to house metal can 133 with pressurized disinfectant 132. Evenly spaced lower studs 134 support intermediate layer container 130 on toilet rim whilst upper studs 124 serve to support seat 125 above. Upper spray nozzles 135 located on top surface of container 130, matching surface of seat 125, serve to spray vapour disinfectant 132 to lower surface of seat 125. Side nozzles 136, curved and pointing toward toilet bowl, serve to spray vapour disinfectant 132 onto toilet bowl surface. Ejection nozzle of can 133 is adapted for spraying into gas chamber 137 whilst trigger 138 protrudes outside for manual triggering. Screw fixing blocks 139 on sides of housing 131 are for fixing container 130 to toilet rim. A simple pressing on trigger 138 thus serves to actuate disinfection for both toilet seat 125 with reversible surfaces and a toilet bowl below.

Alternatively, a pivotal porous seat allowing vapour to pass to upper seat surface may be used; or, container 130 may be merged with a toilet rim. To allow disinfecting toilet seat and toilet bowl separately, gas chamber 137 may consist of an upper chamber and a lower chamber and employ two cans of disinfectant. Automatic or remote controls, including detection of approaching or departing users, may also be added for user selection as previously described.

It is hereby recapitulated that various suitable disinfecting means, including but not limited to, solid disinfecting agents, liquid disinfecting agents, vapour disinfectant, freezing agents, heat generators, light generators, supersonic generators, microwave generator, lasers, brushes and wipers may be interchangeably employed in different embodiments with appropriate modifications. Also, various disinfecting processes, including but not limited to, direct contact, brushing, wiping, immersion, diffusion, capillary attraction, conduction, vaporization, wave transmission including light wave, supersonic wave and laser, radiation and microwave may also be interchangeably employed, with appropriate modifications, in different embodiments, and are all within scope of this invention. Similarly, various trigger means and sensing means, including but not limited to, manual means, magnetic means, pressure means, light sensitive means, sound sensitive means and proximity sensing means may be interchangeably employed in different embodiments, or incorporated into any single embodiment for user selection, with appropriate modifications, and are within scope of this invention. Also, mounting means may be separate or merged with seat or with container, and are within scope of present invention.

I claim:

1. A disinfecting toilet seat system comprising:

a toilet seat with at least one seat surface, disinfecting means for disinfecting said toilet seat, at least one containing means to hold said disinfecting means, trigger means to trigger disinfection of said toilet seat, means mounting said toilet seat for pivoting movement and/or seat surface sequencing relative to said at least one containing means, and means mounting said at least one containing means for pivoting movement relative to said toilet seat and/or mounting said at least one containing means between said toilet seat and a toilet bowl, wherein said containing means comprises at least one element generally matching said at least one seat surface, and maintains said disinfecting means in orientation to facilitate application of disinfection to said toilet seat when said containing means and said toilet seat are within predetermined proximity of each other.

2. The disinfecting toilet seat system of claim 1, wherein said at least one containing means comprises a seat cover.

3. The disinfecting toilet seat system of claim 1, wherein said at least one containing means comprises an intermediate layer between said toilet seat and a toilet rim.

4. The disinfecting toilet seat system of claim 1, wherein said at least one containing means constitutes part of a toilet rim.

5. The disinfecting toilet seat system of claim 3 or 4, further comprising a seat cover.

6. The disinfecting toilet seat system of claim 1, wherein said toilet seat is orientable to render successive seat surfaces for disinfection.

7. The disinfecting toilet seat system of claim 6, wherein said toilet seat further comprises a ball joint for rotational movement.

8. The disinfecting toilet seat system of claim 1, wherein said toilet seat further comprises communication means to facilitate passing through of disinfecting agent toward said at least one seat surface.

9. The disinfecting toilet seat system of claim 1, further comprising means to disinfect a toilet bowl.

10. The disinfecting toilet seat system of claim 9, wherein said trigger means further triggers toilet bowl disinfection.

11. The disinfecting toilet seat system of claim 1, further comprising coupling means for coupling to toilet water delivery system in a manner that said trigger means further triggers toilet cleaning water.

12. The disinfecting toilet seat system of claim 1, wherein said trigger means is manually operated and/or remote control operated.

13. The disinfecting toilet seat system of claim 1, further comprising sensing means to detect said predetermined proximity between said toilet seat and said containing means, and, in response to said predetermined proximity detected, triggers to disinfect said toilet seat.

14. The disinfecting toilet seat system of claim 13, wherein that said sensing means is sensitive to pressure and/or light and/or sound and/or radio wave and/or magnetism.

15. The disinfecting toilet seat system of claim 1, further comprising means to detect approaching and/or departing objects, and, in response to approaching and/or departing objects detected, triggers to disinfect said toilet seat and/or a toilet bowl.

16. The disinfecting toilet seat system of claim 1, wherein said disinfecting means comprises at least one of liquid disinfecting agent, solid disinfecting agent, vapour disinfecting agent, freezing agent, heat generator, light generator, supersonic generator, laser, microwave generator, wiping means and brushing means.

17. The disinfecting toilet seat system of claim 1, wherein disinfection involves at least one of direct contact, conduction, spraying, diffusion, vaporization, radiation, light transmission, wave transmission, surface tension, capillary attraction and mechanical manipulation of said disinfecting means.

18. The disinfecting toilet seat system of claim 1, wherein disinfection discontinues automatically after a predetermined duration of time and/or after a predetermined amount of disinfectant applied.

* * * * *